US005247819A

United States Patent [19]

Morimoto et al.

[11] Patent Number: 5,247,819

[45] Date of Patent: Sep. 28, 1993

[54] BORE PROCESSING DEVICE

[75] Inventors: Masato Morimoto, Neyagawa; Takafumi Asada, Hirakata, both of Japan

[73] Assignee: Matsushita Electrical Industrial Co. Ltd., Kadoma, Japan

[21] Appl. No.: 944,031

[22] Filed: Sep. 11, 1992

Related U.S. Application Data

[63] Continuation of Ser. No. 927,737, Aug. 12, 1992, abandoned, which is a continuation of Ser. No. 707,808, May 30, 1991, abandoned.

[30] Foreign Application Priority Data

Jun. 1, 1990 [JP] Japan ..... 2-144723

[51] Int. Cl.[5] ..... B21D 39/10

[52] U.S. Cl. ..... 72/122; 72/19; 72/125

[58] Field of Search ..... 72/19, 20, 21, 26, 30, 72/84, 118, 120, 122, 123, 125, 126

[56] References Cited

U.S. PATENT DOCUMENTS

| | | | |
|---|---|---|---|
| 1,114,351 | 10/1914 | Heisler | 72/118 |
| 3,564,883 | 2/1971 | Koors et al. | 72/19 |
| 3,585,701 | 6/1971 | Stary | 72/20 |
| 3,736,633 | 6/1973 | Kalen | 72/122 |
| 4,602,492 | 7/1986 | Brif et al. | 72/122 |
| 4,658,616 | 4/1987 | Bastone | 72/19 |
| 4,693,105 | 9/1987 | Lee, Jr. | 72/84 |

FOREIGN PATENT DOCUMENTS 0041248 12/1981 European Pat. Off. .

*Primary Examiner*—Lowell A. Larson

*Attorney, Agent, or Firm*—Wenderoth, Lind & Ponack

[57] ABSTRACT

A bore processing device for processing an inner surface of a bore of an object to be processed, includes: a taper member having a taper section; a roller arranged to contact and rotate around an outer surface of the taper member; a roller guide member having a guide groove for accommodating the roller and arranged to rotate around the outer surface of the taper member; a first motor for moving the roller guide member to insert the roller into the bore of the object; a second motor for rotating one of the object and the roller guide member; and a third motor for axially moving one of the roller guide member and the taper member so that one of the roller guide member and the taper member relatively moves to the other thereof. The device further includes a detecting device for detecting an axial load applied to the object by the roller when the roller is inserted into the bore of the object.

2 Claims, 3 Drawing Sheets

BORE PROCESSING DEVICE

This application is a Rule 1.62 continuation of now abandoned application Ser. No. 07/927,737, filed Aug. 12, 1992, which in turn is a continuation of now abandoned application Ser. No. 07/707,808, filed May 30, 1991.

BACKGROUND OF THE INVENTION

The present invention relates to a bore processing device for processing an inner surface of a bore of an object to be processed. More specifically, the present invention relates to a bore processing device for processing the bore of a high-accuracy bearing at high accuracy of cylindricity and surface roughness with plastic working, without a polishing process in which the bore is susceptible to flaws.

Recently, high-accuracy bearings rotatable at high speed are used in business machines and consumer equipment and it has become necessary to develop a hydrodynamic grooved bearing or a fluid bearing with higher accuracy.

For the finishing process in the plastic working of the bearing bore, there is a known method, called a pin sizing method, in which a pin is passed through the bore under pressure, and a known method, called a roller burnishing method, in which a roller is passed rotating through the bore as shown in FIGS. 5 to 7.

Referring to the drawings, one example of the known methods will be described hereinbelow. FIG. 5 is a cross-sectional view of a conventional bearing processing device. Reference numeral 11 denotes a roller guide having a plurality of guide grooves 11*a* in each of which a roller 12 is rotatably accommodated. A processing tool 14 of the device is composed of the rollers guide 11 and the roller 12. Reference numeral 13 denotes a sleeve of the bearing as an object to be processed.

The operation of the bearing bore processing device will be described hereinbelow.

Firstly, the sleeve 13 is set on a working table (not shown) and thereafter the processing tool 14 is downwardly moved in the bore of the sleeve 13 while rotating. At the time, since the processing tool 14 is designed to have the circle circumscribing the plurality of rollers 12 each of which has a diameter greater by a few micron meters or ten micron meters than the inner diameter of the bore of the sleeve 13, the rollers 12 pass through the bore of the sleeve 13 under pressure while the processing tool 14 is rotating with the rollers 12, thus causing plastic deformation in the sleeve 13 to obtain the necessary inner diameter and surface roughness of the bore of the sleeve.

However, the device has the following drawbacks: that is, in the plastic working process, as shown in FIG. 7, it is easy to deform at both the ends of the bore of the sleeve, and then the bore has a tendency to the cylindricity $\delta$ to gradually protrude at the center thereof and form a curved shape in cross-section. Additionally, when there is a variation within 20 micron meters in the inner diameter of the sleeve bore before a plastic working process, the bore has a variation within 10–15 micron meters in the inner diameter thereof after the plastic working process. Therefore, in a fluid bearing having a sleeve, there is much radial run-out and a variation in performance of sleeves made in quantity production.

SUMMARY OF THE INVENTION

Accordingly, an essential object of the present invention is to provide a bore processing device capable of improving the accuracy of the inner diameter and cylindricity of a bore of an object to be processed.

In accomplishing these and other objects, according to one aspect of the present invention, there is provided a bore processing device for processing an inner surface of a bore of an object to be processed, comprising:

a taper member having a taper section;

a roller arranged to contact and rotate around an outer surface of the taper member;

a roller guide member having a guide groove for accommodating the roller and arranged to rotate around the outer surface of the taper member;

a first motor for moving the roller guide member to insert the roller into the bore of the object;

a second motor for rotating one of the object and the roller guide member; and a third motor for axially moving one of the roller guide member and the taper member so that one of the roller guide member and the taper member moves relatively to the other thereof.

By the above construction of the present invention, the cylindricity and the inner diameter of the bore can be improved in accuracy by changing the circle circumscribing the rollers of the tool during the process.

According to another aspect of the present invention, there is provided a bore processing device further comprising a detecting means for detecting an axial load applied to the object by the roller when the roller is inserted into the bore of the object.

By the above construction of the present invention, the inner diameter of the bore is detected by the detecting means and as a result of the detection, the circle can be adjusted in accordance with the detected value, resulting in less variation in the finished inner diameter of the bore.

BRIEF DESCRIPTION OF THE DRAWINGS

These and other objects and features of the present invention will become clear from the following description taken in conjunction with the accompanying drawings throughout which like parts are designated by like reference numerals, and in which.

DETAILED DESCRIPTION OF THE PREFERRED EMBODIMENTS

A bearing bore processing device according to one embodiment of the present invention will be described referring to FIGS. 1 to 4.

Figure 1:
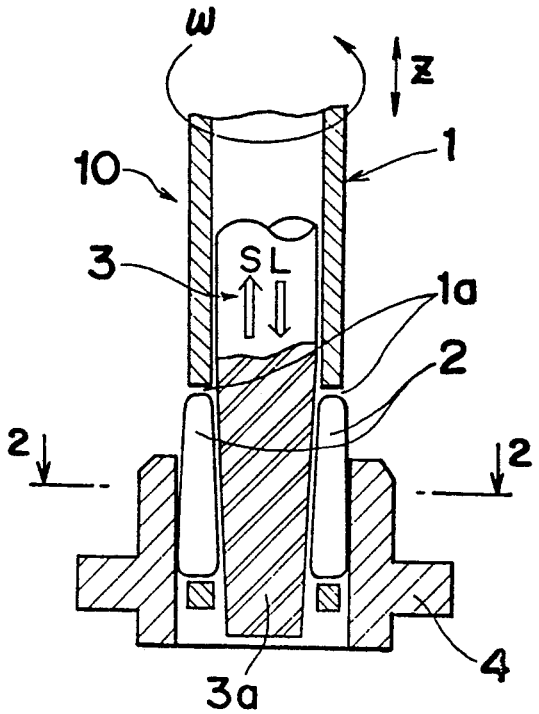
FIG. 1 is a cross-sectional view partially showing the essential parts of a bore processing device according to one embodiment of the present invention.
Figure 2:
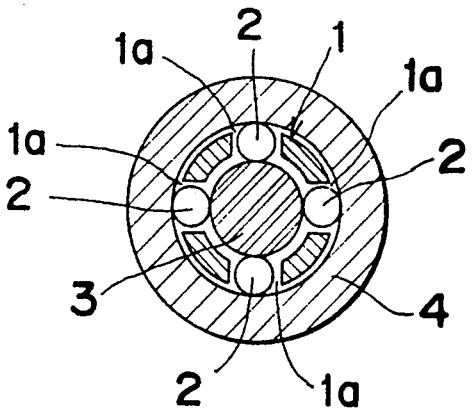
FIG. 2 is a cross-sectional view taken in the line 2—2 of FIG. 1.

In FIG. 1, reference numeral 1 denotes a roller guide having a plurality of guide grooves 1*a* in each of which a roller 2 is rotatably inserted respectively. Reference numeral 3 denotes a taper pin having a taper section 3*a* at one end thereof. The rollers 2 move around the axis of the taper pin 3 with the rotation of the roller guide 1 and the taper pin 3 is capable of moving in the directions shown by the arrows S and L with respect to the roller guide 1 therein so as to adjust the outer diameter of the circle circumscribing the rollers 2.

Figure 4:
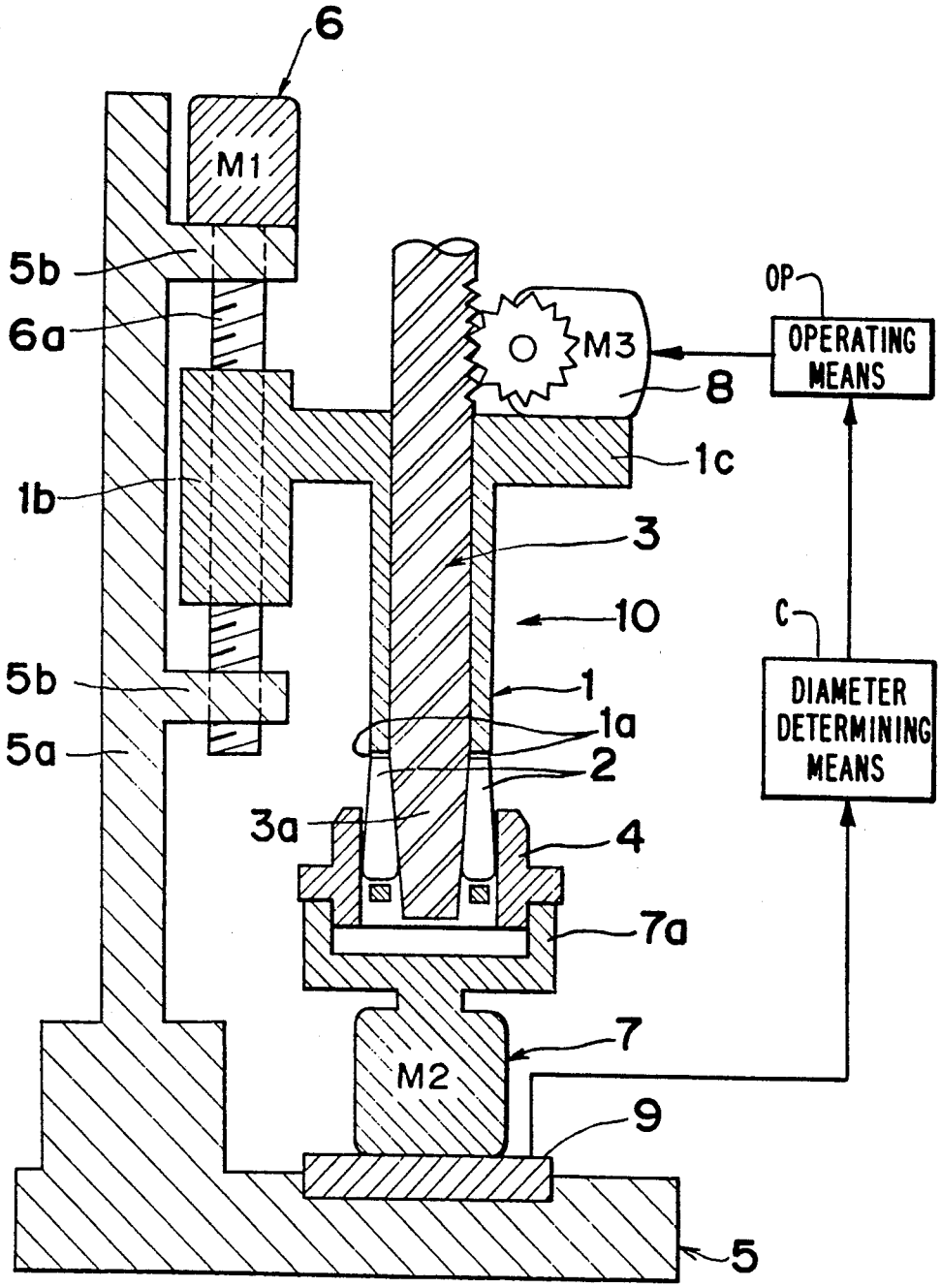
FIG. 4 is a cross-sectional view showing the whole construction of the bore processing device according to the embodiment of the present invention.
Figure 5:
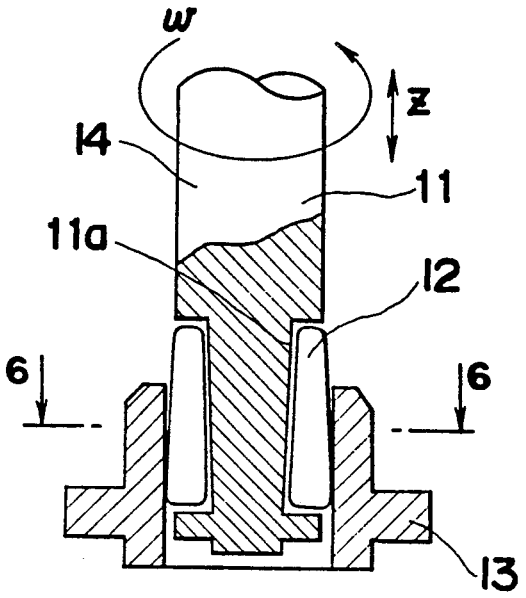
FIG. 5 is a cross-sectional view partially showing a part of a conventional bearing bore processing device.
Figure 6:
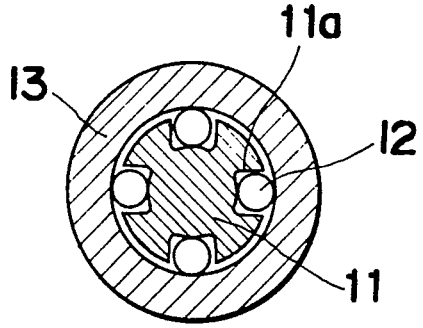
FIG. 6 is a cross-sectional view taken in the line 6—6 of FIG. 5.
Figure 7:
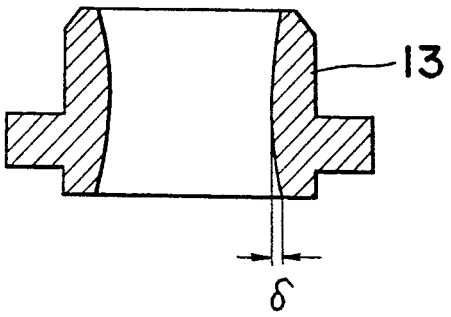
FIG. 7 is a cross-sectional view showing a sleeve processed by the device.

A processing tool 10 including the device is composed of the roller guide 1, the rollers 2, and the taper pin 3. Reference numeral 4 denotes a sleeve of a bearing as an object to be processed. In FIG. 4, reference numeral 5 denotes a base, reference numeral 6 denotes a first motor mounted on the support 5*a* of the base 5 and having a rod 6*a* or a feed screw, rotatably supported with the arms 5*b* of the support 5*a*, for engaging a slider section 1*b* of the roller guide 1. The first motor 6 rotates the rod 6*a* so as to move the taper pin 3 back and forth in the axial direction in the roller guide 1 and change the distance between the roller guide 1 and the sleeve 4, i.e. the diameter of the circle circumscribing the rollers 2. Reference numeral 7 denotes a second motor, mounted on the base 5, for rotating either the sleeve 4 or the guide 1. In this embodiment, the second motor 7 rotates the sleeve 4 through a chuck 7*a* connected to the second motor 7. The sleeve 4 is held by the chuck 7*a*. Reference numeral 8 denotes a third motor, mounted on the upper flange 1*c* of the roller guide 1, for under control of an operating means OP, moving the taper pin 3, and reference numeral 9 denotes a load sensor, mounted between the base 5 and the second motor 7, for detecting the axial load of the rollers 2 when the rollers 2 of the tool 10 are inserted in the bore of the sleeve 4 under pressure.

With this construction of the device, the operation thereof will be described hereinbelow. In FIG. 4, the sleeve 4 is rotated by the second motor 7 through the chuck 7*a* and the tool 10 is inserted in the bore of the sleeve 4 under pressure by the rotation of the first motor 6 so that the inner diameter of the bore of the sleeve 4 becomes larger. Thus, in this processing operation, the accuracy of the surface roughness thereof can be improved.

Figure 3:
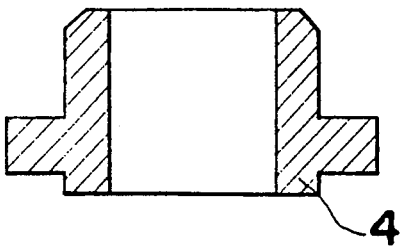
FIG. 3 is a cross-sectional view showing a sleeve processed with the device.

In the processing operation, the taper pin 3 is moved with respect to the rollers 2 by the rotation of the third motor 8. Then, the diameter of the circumscribed circle of the rollers 2 is adjustable in the following way. That is, when the inlet and outlet parts of the sleeve bore are processed, the diameter of the circumscribed circle becomes a specified valve, while when a portion other than the ends of the sleeve bore, i.e., the middle part, is processed, the diameter of the circumscribed circle becomes larger than the specified valve. Thus, as shown in FIG. 3, the sleeve 4 with improved accuracy of cylindricity can be processed.

In FIG. 4, the taper pin 3 is moved by the third motor 8 to set the diameter of the circumscribed circle of the rollers 2 to the specified value and then in this condition, the tool 10 is inserted under pressure in the bore of the sleeve 4 by the first motor 6. The load in inserting the tool 10 into the sleeve 4 is detected by the load sensor 9 and the output is supplied to a bore size determining means c for determining the inner diameter of the bore of the sleeve 4 based on the detected value of the load. Then, the necessary amount of plastic processing and the diameter of the circumscribed circle of the rollers 2 are in said determining means by comparison with a specified valve in order to finish the inner diameter of the bore to the specified value. Then, the rotation of the third motor 8 causes the diameter of the circumscribed circle of the rollers 2 to increase in the middle part and decrease in the outlet part in accordance with the necessary amount of plastic processing, while the rotations of the first and second motors 6 and 7 cause the rollers 2 to work the interior surface of sleeve 4, whereby the inner diameter of the sleeve 4 finished is to a specified value and has improved accuracy of cylindricity by the above processing operations.

According to the embodiment, the inner diameter of the sleeve 4 and the cylindricity thereof can be accurately processed by changing the outer diameter of the tool 10. Instead of the rotation of the sleeve 4, the second motor 7 can rotate the roller guide 1.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A bore processing device for processing an inner surface of an object to be processed, the bore having an inlet part and an outlet part and a middle part therebetween, said device comprising:

a taper member having a taper section;

a plurality of rollers positioned around and contacting the outer surface of said taper member for rotating around the outer surface of said taper member;

a roller guide member rotatably mounted around said taper member and having guide grooves in which said rollers are rotatably mounted for rotating around the outer surface of said taper member;

a first motor operatively associated with said rollers for axially moving said rollers into the bore of the object;

a second motor operatively associated with one of the object and the roller guide member for rotating one of the object and the roller guide member;

a third motor operatively associated with the taper member for axially moving the taper member relative to said roller guide member;

said first motor being operable for moving said roller guide member to move the rollers into and through the inlet, middle and outlet parts of the bore of the object while said second motor operates one of the object and the roller guide member; and operating means connected to said third motor to move said taper member to set the diameter of a circle circumscribed around said rollers to a specified value as said rollers are moved through the inlet part of the bore of the object by the operation of said first motor, to move said taper member to increase the diameter of a circle circumscribed around said rollers as said rollers are moved through the middle part of the bore of the object by the operation of the first motor, and to move said taper members to decrease the diameter of the circle circumscribed around the rollers as said rollers are moved through the outlet part of the bore of the object, the setting, increasing and decreasing the diameter of the circumscribed circle being for finishing the bore of the object to the specified value with improved cylindricity.

2. A method of processing an inner surface of a bore of an object to be processed, the bore having an inlet part an outlet part and a middle part therebetween, by the use of a bore processing device having a taper member having a taper section, a plurality of rollers positioned around and contacting outer surface of said taper member for rotating around the outer surface of the taper member, a roller guide member rotatably mounted around said taper member and having guide grooves in which said rollers are rotatably mounted for rotation around the outer surface of said taper member, a first motor operatively associated with said rollers for axially moving the rollers into the bore of the object, a second motor operatively associated with one of the object and the roller guide member for rotating one of the object and the roller guide member, and a third motor operatively associated with the taper member for axially moving the taper member relative to said roller guide member, said method comprising:

driving said first motor for moving the rollers to insert the rollers into and through the inlet, middle and outlet parts the bore of the object while driving said second motor to rotate one of the object and the roller guide member, and driving said third motor to move the taper member to set the diameter of a circle circumscribed around said rollers to a specified value as said rollers are moved through the inlet part of the bore of the object by the operation of said first motor, to move said taper member to increase the diameter of a circle circumscribed around said rollers as said rollers are moved through the middle part of the bore of the object by the operation of the first motor, and to move said taper member to decrease the diameter of the circle circumscribed around the rollers as said rollers are moved through the outlet part of the bore of the object, the setting, increasing and decreasing the diameter of the circumscribed circle being for finishing the bore of the object to the specified value with improved cylindricity.

* * * * *

UNITED STATES PATENT AND TRADEMARK OFFICE

CERTIFICATE OF CORRECTION

PATENT NO. : 5,247,819
DATED : September 28, 1993
INVENTOR(S) : Masato Morinoto, et. al.

It is certified that error appears in the above-indentified patent and that said Letters Patent is hereby corrected as shown below:

On the Title page, item [73] Assignee: "Electrical", should read--Electric--

Signed and Sealed this

Twenty-second Day of February, 1994

*Attest:*

Bruce Lehman

BRUCE LEHMAN

*Attesting Officer*

*Commissioner of Patents and Trademarks*